US008139966B2

(12) United States Patent
Murakami

(10) Patent No.: US 8,139,966 B2
(45) Date of Patent: Mar. 20, 2012

(54) IMAGE FORMING SYSTEM HAVING A DENSITY CORRECTION UNIT

(75) Inventor: Masahiro Murakami, Hekinan (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 1185 days.

(21) Appl. No.: 11/902,690

(22) Filed: Sep. 25, 2007

(65) Prior Publication Data

US 2008/0118257 A1 May 22, 2008

(30) Foreign Application Priority Data

Sep. 29, 2006 (JP) ..... 2006-266912

(51) Int. Cl.
*G03G 15/00* (2006.01)

(52) U.S. Cl. ..... 399/49; 399/72

(58) Field of Classification Search ..... 399/27–30, 399/49, 60, 62, 72
See application file for complete search history.

(56) References Cited

U.S. PATENT DOCUMENTS

| | | | | |
|---|---|---|---|---|
| 5,839,018 | A * | 11/1998 | Asanuma et al. | |
| 6,804,025 | B1 | 10/2004 | Ueda et al. | |
| 6,963,424 | B1 | 11/2005 | Higuchi | |
| 7,110,687 | B2 | 9/2006 | Furukawa | |
| 7,912,393 | B2 * | 3/2011 | Yamada | 399/72 |
| 2004/0253013 | A1 * | 12/2004 | Furukawa | 399/49 |
| 2005/0185973 | A1 * | 8/2005 | Hama et al. | 399/27 |
| 2005/0281572 | A1 * | 12/2005 | Kawakami et al. | 399/49 |
| 2006/0204256 | A1 * | 9/2006 | Sakamoto | 399/27 |
| 2008/0025738 | A1 * | 1/2008 | Ahn et al. | 399/27 |

FOREIGN PATENT DOCUMENTS

| | | |
|---|---|---|
| JP | 10-198222 | 7/1998 |
| JP | 2000-253252 | 9/2000 |
| JP | 2000-278543 | 10/2000 |
| JP | 2001-18498 | 1/2001 |
| JP | 2001-147620 | 5/2001 |
| JP | 2002-271625 | 9/2002 |
| JP | 2002-351183 | 12/2002 |
| JP | 2003-149907 | 5/2003 |
| JP | 2004-294471 | 10/2004 |
| JP | 2006-40297 | 2/2006 |
| JP | 2006-217192 | 8/2006 |

OTHER PUBLICATIONS

Japanese Office Action, with English Translation, issued in Japanese Patent Application No. JP 2006-266912 dated on Sep. 9, 2008.

* cited by examiner

*Primary Examiner* — David Porta
*Assistant Examiner* — Milton Gonzalez
(74) *Attorney, Agent, or Firm* — McDermott Will & Emery LLP

(57) ABSTRACT

An image forming system includes an image forming unit, a measurement unit, a correction unit, and an inhibition unit. The image forming unit forms an image. The measurement unit measures densities of a plurality of density patches formed by the image forming unit. The correction unit performs a density correction for the image forming unit based on the densities of the plurality of density patches measured by the measurement unit. The inhibition unit determines whether or not the densities of the plurality of the density patches are normal based on at least one of the densities of the plurality of density patches, and, if the densities are determined not to be normal, inhibits the correction unit from performing a density correction based on the densities of the plurality of density patches determined to be not normal.

16 Claims, 11 Drawing Sheets

IMAGE FORMING SYSTEM HAVING A DENSITY CORRECTION UNIT

CROSS-REFERENCE TO RELATED APPLICATIONS

This application claims the benefit of Japanese Patent Application No. 2006-266912 filed Sep. 29, 2006 in the Japan Patent Office, the disclosure of which is incorporated herein by reference.

BACKGROUND

The present invention relates to an image forming system that forms an image.

Conventionally an image forming system is known which performs a density correction (so-called calibration), in order to correct a change in the characteristics of image formation which is caused due to aging of the image forming system and the like. In the density correction, a plurality of density patches are formed, densities of the respective patches are measured, and a correction is performed based on the measured densities.

SUMMARY

In calibration performed by the above-described conventional image forming system, a density correction is performed on the premise that the densities of patches are correctly measured. However, there is a possibility that correct measurement result cannot be obtained, such as in a case wherein density patches cannot be properly formed, in a case wherein the densities of patches cannot be correctly measured although patches are properly formed, and so on. In such cases, there is a problem in that a density correction is performed based on an incorrect measurement result, and that the change in the characteristic of image formation becomes rather worsened.

In an image forming system, an inappropriate density correction based on an incorrect measurement result is preferably inhibited.

In one aspect of the present invention, an image forming system includes an image forming unit, a measurement unit, a correction unit, and an inhibition unit. The image forming unit forms an image. The measurement unit measures densities of a plurality of density patches formed by the image forming unit. The correction unit performs density correction for the image forming unit based on the densities of the plurality of density patches measured by the measurement unit. The inhibition unit determines whether or not the densities of the plurality of the density patches are normal based on at least one of the densities of the plurality of density patches, and, if the densities are determined not to be normal, inhibits the correction unit from performing a density correction based on the densities of the plurality of density patches determined to be not normal.

In the image forming system configured as above, since a density correction is inhibited, when the densities of the plurality of the density patches, measured by the measurement unit, are not normal, the image forming unit can be inhibited from performing density correction based on the densities of the plurality of density patches which are determined to be not normal. Therefore, an inappropriate correction can be inhibited.

BRIEF DESCRIPTION OF THE DRAWINGS

The invention will now be described below, by way of example, with reference to the accompanying drawings, in which.

DETAILED DESCRIPTION OF THE PREFERRED EMBODIMENT

[1. Overall Structure]

Figure 1:
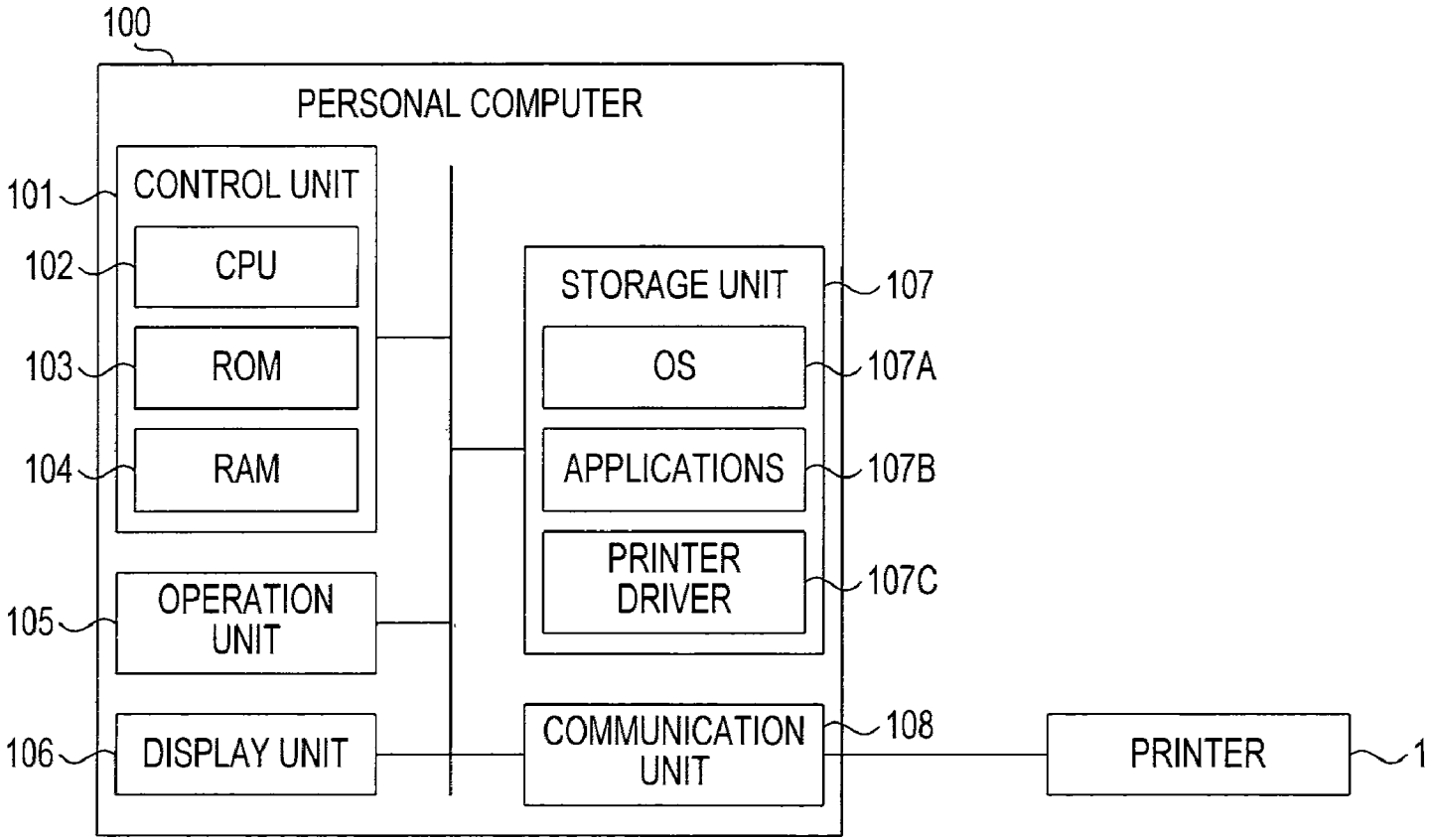
FIG. 1 is a block diagram showing an overall structure of an image forming system according to an embodiment of the present invention.

As shown in FIG. 1, an image forming system according to the present embodiment includes a printer 1 and a personal computer (PC) 100. The present image forming system is configured such that the printer 1 and the PC 100 can communicate each other via a network (in the present embodiment, LAN: Local Area Network).

[2. Structure of PC]

The PC 100 includes a control unit 101, an operation unit 105, a display unit 106, a storage unit 107, and a communication unit 108.

The control unit 101 is constituted mainly with a known microcomputer, including a CPU 102, a ROM 103, a RAM 104, and controls the respective units constituting the PC 100.

The operation unit 105 is provided for inputting instructions given from a user by an external operation, wherein, for example, a keyboard, a pointing device (a mouse etc.), and so on are used.

The display unit 106 is provided so as to display a variety of information in the form of images so that the information becomes visible to a user. A liquid crystal display is used, for example.

The storage unit 107 is provided so as to store a variety of information. For example, a hard disc device is used for the storage unit 107. In the storage unit 107, an operating system (OS) 107A, application programs (to be simply referred to as applications) 107B such as a word processing software, an image viewing software, and so on, and a printer driver 107C for a printer 1 are installed.

The communication unit 108 performs data transmission (sending/receiving) via a network.

[3. Structure of Printer]

Figure 2:
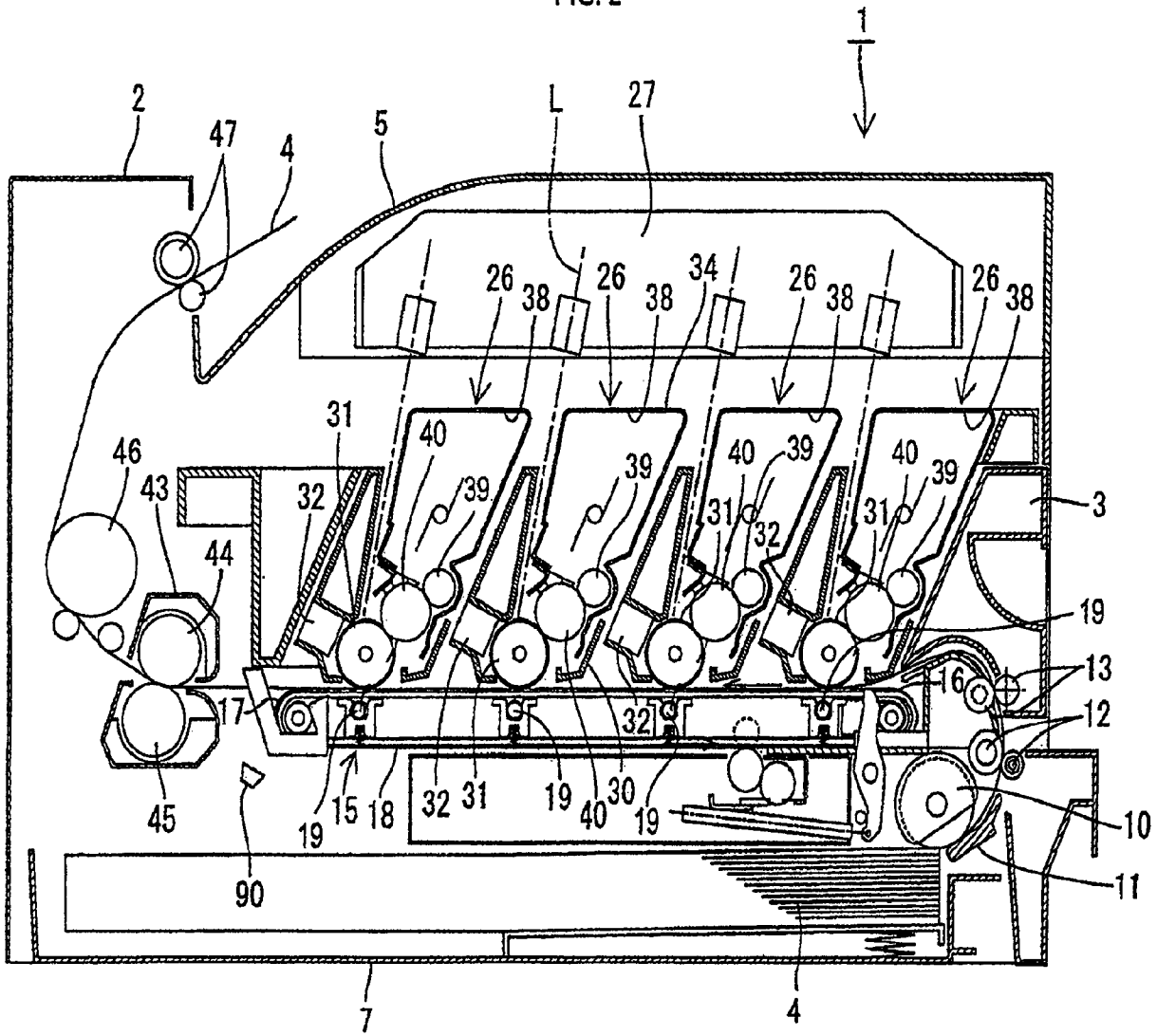
FIG. 2 is a sectional side view showing an overall structure of a printer of the image forming system.

As shown in FIG. 2, the printer 1 is a color laser printer wherein tandem electrophotographic and direct printing are adopted, and has a body casing 2 formed approximately in a box shape. To the front surface of the body casing 2 (in the right side in the drawing), an openable/closable front cover 3 is provided. On the top surface of the body casing 2, a paper discharge tray 5 is formed on which recording media (wherein images are recorded (printed) thereon, such as sheet-like media, for example, paper and the like) 4 are stacked after printing is performed. In the bottom portion of the body casing 2, a paper feed tray 7 is installed on which recording media 4, before printing is performed thereon, are stacked.

The recording medium 4, placed on the uppermost on the paper feed tray 7, is separated by the rotation of a pickup roller 10 from the rest of the stacked recording media in a sheet-by-sheet manner, when the recording medium 4 is sandwiched between the pickup roller 10 and a separation pad 11. Then, the recording medium 4 is fed to registration rollers 13 by paper feed rollers 12. The registration rollers 13 feed the recording medium 4 to a belt unit 15, disposed behind the registration rollers 13, at a predetermined timing.

The belt unit 15 includes a conveyance belt 18 horizontally disposed around one pair of supporting rollers 16 and 17. The supporting rollers 16 and 17 are disposed so as to be separated from each other in the front and the rear. The supporting roller 17 disposed in the rear is a driving roller rotated by the power from a driving motor (not shown). The supporting roller 16 disposed in the front is a tension roller (a driven roller) for applying tension to the conveyance belt 18. The conveyance belt 18 is an endless belt made of a resin material, such as polycarbonate and the like, and conveys a recording medium 4, placed on the top surface thereof, toward the rear portion of the printer 1. In the inner side surrounded by the conveyance belt 18, four transfer rollers 19, respectively face photoreceptor drums 31 (to be described later), are aligned in a front-to-rear direction so as to have a predetermined interval therebetween.

Above the belt unit 15, four process cartridges 26, respectively corresponding to cyan, magenta, yellow, and black colors, are aligned in the front-to-rear direction, and removably installed. Above the process cartridges 26, a scanner unit 27 is disposed. The scanner unit 27 emits laser beams L based on predetermined image data onto the surfaces of the photoreceptor drums 31 corresponding to the respective colors, and performs a high-speed scanning of the laser beams L.

Each of the process cartridges 26 includes a cartridge frame 30, the photoreceptor drum 31, a scortron-type charger 32, and a development cartridge 34. The photoreceptor drum 31 and the scortron-type charger 32 are disposed in the bottom portion of the cartridge frame 30. The development cartridge 34 can be attached/detached to/from the cartridge frame 30, and is provided with a toner storage 38 inside thereof. The toner storage 38 includes, inside thereof, a supply roller 39, and a development roller 40.

A fixing device 43 fixes toner images on a recording medium 4 by heating a recording medium 4 maintaining toner images in for colors thereon, while a heat roller 44 and a pressure roller 45 sandwich and convey the recording medium 4. The recording medium 4, on which heat fixation is performed, is conveyed to paper discharge rollers 47, disposed in the upper portion of the body casing 2, by a conveyance roller 46 disposed behind and above the fixing device 43. Then, the recording medium 4 is discharged onto the above-described paper discharge tray 5 by the paper discharge rollers 47.

Figure 3:
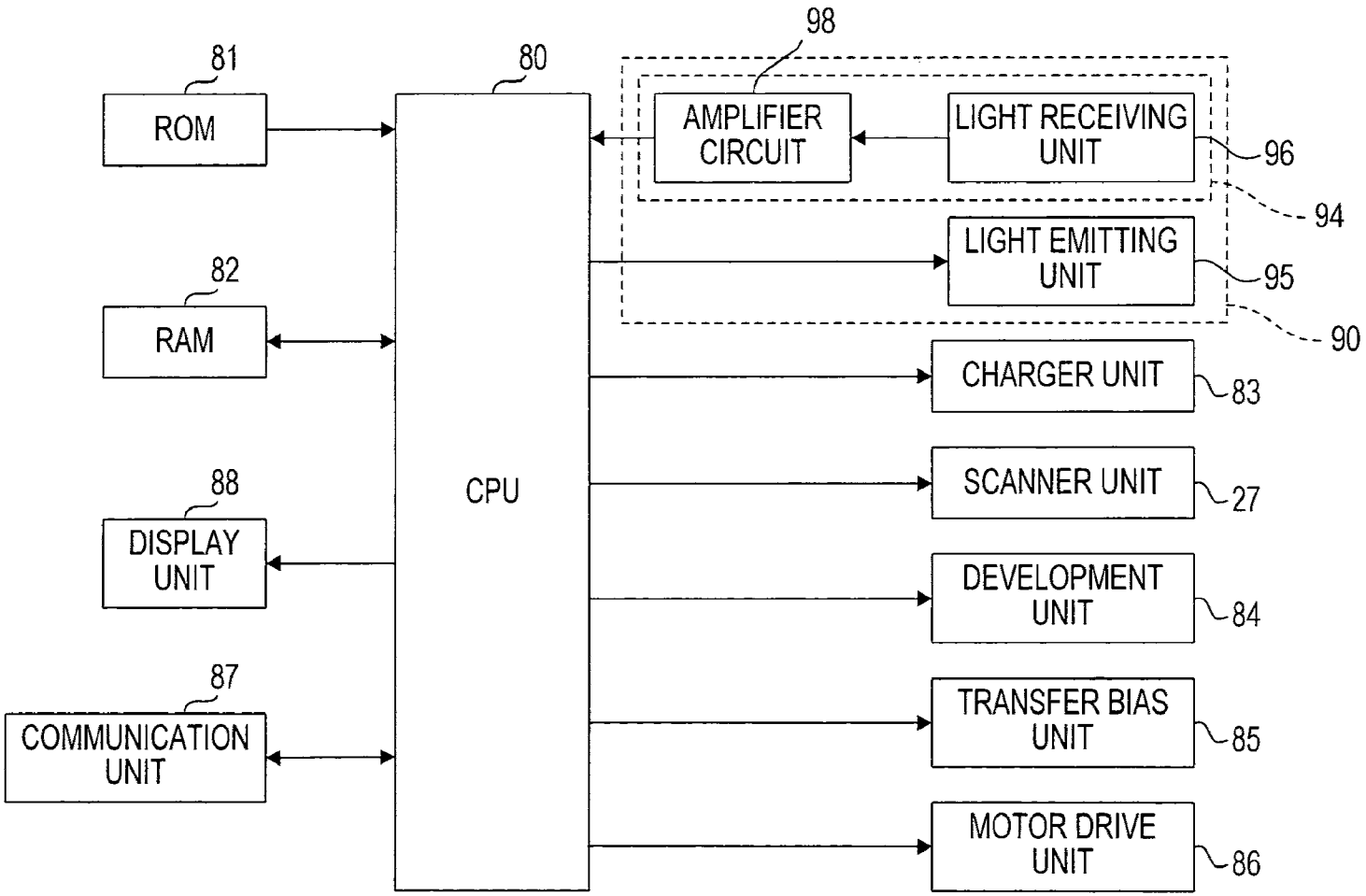
FIG. 3 is block diagram showing the structure of a control system of the printer.

As shown in FIG. 3, the printer 1 is provided with a CPU 80 which controls the entire printer 1. To the CPU 80, a ROM 81, which stores operation programs and so on for the entire printer 1, and a RAM 82, which stores image data and so on used for a print process, are connected. The CPU 80 controls a charging unit 83, which drives the scortron-type charger 32, a development unit 84, which drives the scanner unit 27 and the development cartridges 34, and a transfer bias unit 85, which transfers toner images formed on the photoreceptor drums 31 onto a recording medium 4. The CPU 80 also controls a motor driving unit 86 that drives a drum motor, which is the driving source of the photoreceptor drums 31, and the driving motor of the supporting roller 17, which drives the conveyance belt 18.

The CPU 80 is connected to the PC 100 via the communication unit 87. The printer 1 drives and controls the scanner unit 27 and other units based on image data inputted from the PC 100. To the CPU 80, a display unit 88, including a LCD (Liquid Crystal Display), is connected.

Furthermore, to the CPU 80, a density sensor 90 is connected. The density sensor 90 includes a light emitting unit 95 and a light receiving sensor 94 constituted with a light receiving unit 96 and an amplifier circuit 98. The density sensor 90 is configured such that signals from the light receiving sensor 94 are inputted into the CPU 80.

Figure 4:
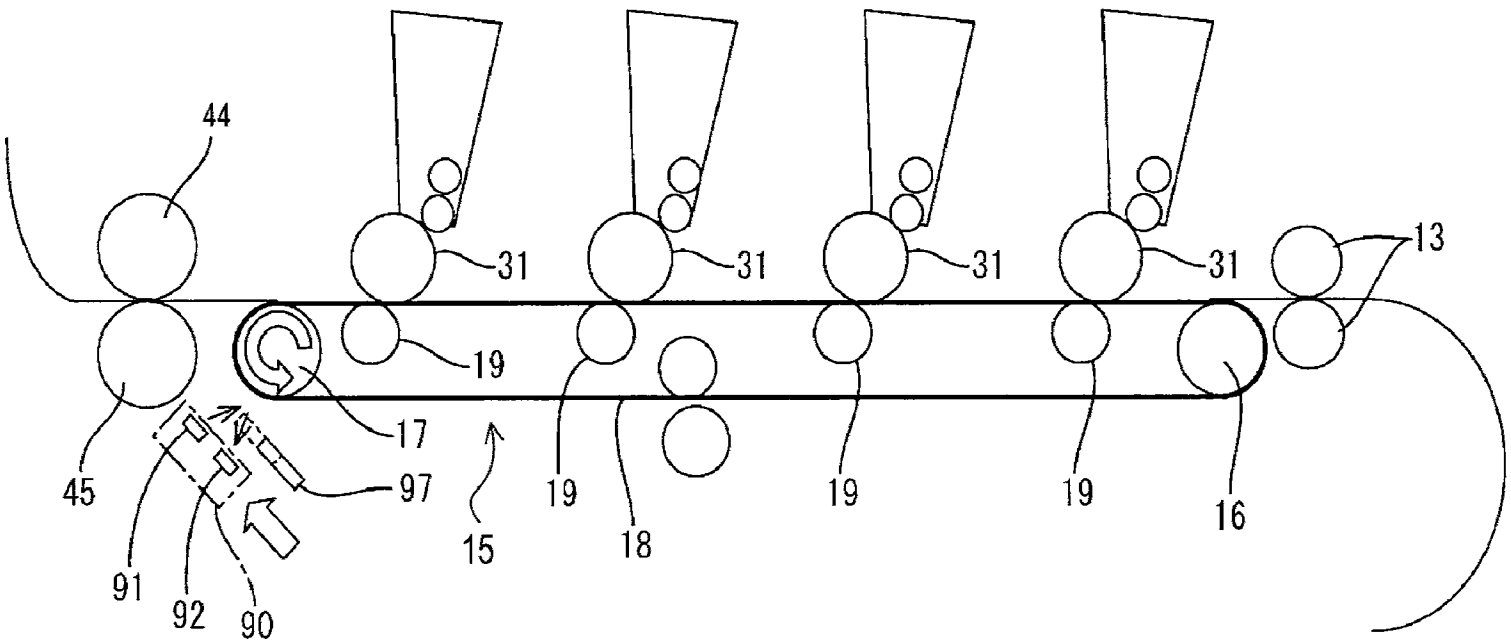
FIG. 4 is an explanatory view generally illustrating a manner of density measurement performed by a density sensor of the printer.

The following describes the density sensor 90 in detail with reference to FIG. 4. The light emitting unit 95 of the density sensor 90 is provided with a light emitting element 91 constituted with infrared LEDs. The light receiving unit 96 is provided with a light receiving element 92 constituting with photodiodes. The density sensor 90 is configured as a reflective photo sensor. The density sensor 90 is disposed behind and below the belt unit 15. Specifically, the light emitting element 91 is disposed at an angle so as to be inclined with respect to the surface of the conveyance belt 18. The light receiving element 92 is disposed in a position so as to receive a specular reflection of light emitted from the light emitting element 91 and reflected on the conveyance belt 18.

Between the light receiving element 92 and the conveyance belt 18, a displaceable shutter 97 is provided. The shutter 97 is driven by an actuator (solenoid, motor, and the like) controlled by the CPU 80. The shutter 97 is configured so as to be moved to a shutting position (the position shown by the dotted line in FIG. 4) so as to shut the light receiving element 92, and to a withdrawn position (the position shown by the full line in FIG. 4) where the shutter 97 is withdrawn from the shutting position so as to permit the light receiving element 92 to receive reflected light.

In the printer 1 according to the present embodiment, a density correction (calibration) based on measured values (a result of density measurement) is performed by directly forming density patches, which are images for density determination, on the conveyance belt 18, and measuring the densities of the patches by the density sensor 90. Specifically, a plurality of density patches are formed on the conveyance belt 18 with respect to the four colors (cyan, magenta, yellow, and black) wherein the densities of the density patches of the respective colors are gradually changed by a predetermined value. Light is emitted from the light emitting element 91, disposed in the light emitting unit 95, to the density patches. The densities of the patches are measured by the reflected light received by the light receiving unit 96.

[4. Process Performed by PC]

Figure 5:
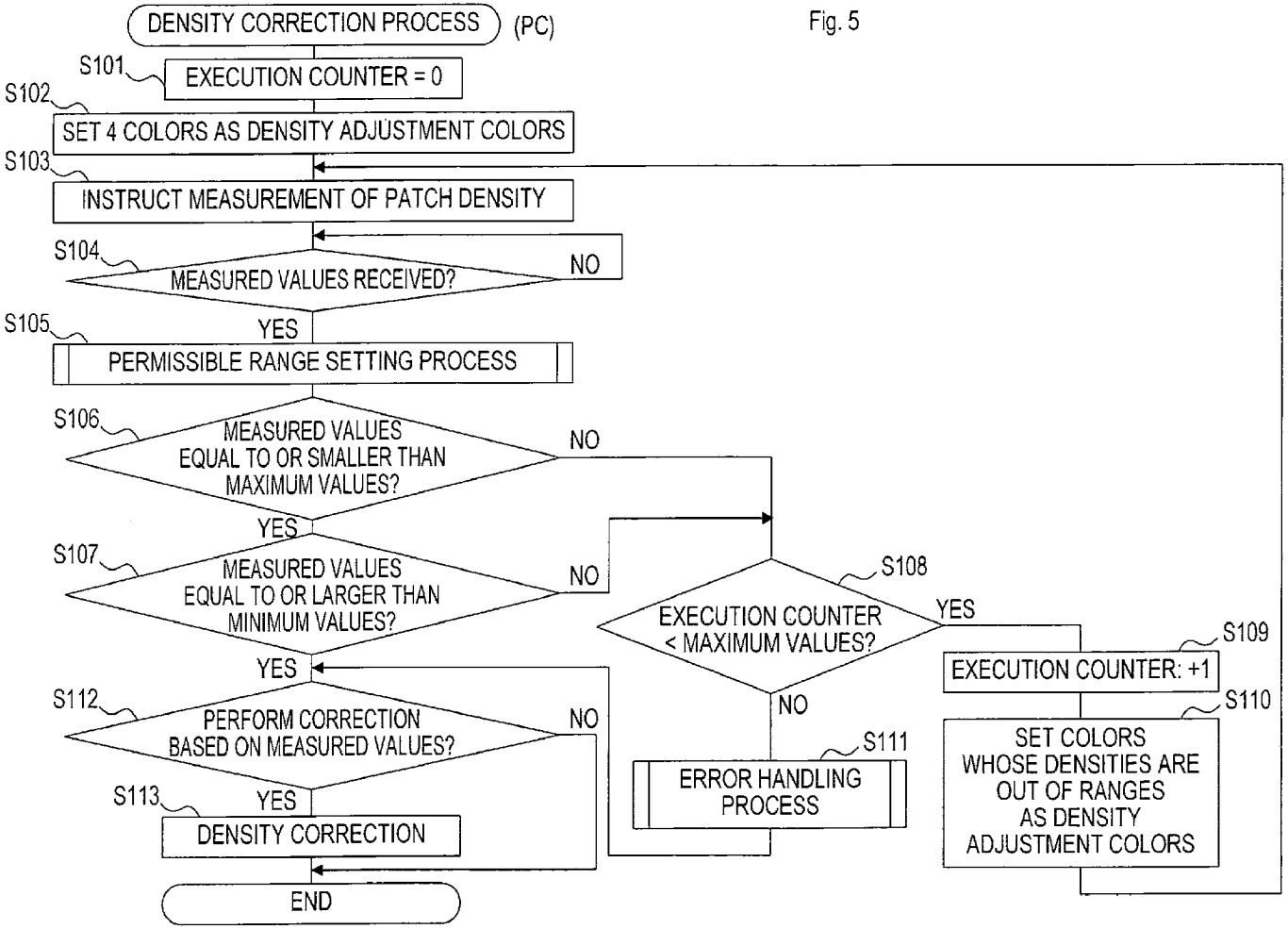
FIG. 5 is a flowchart describing a density correction process performed in a personal computer of the image forming system.
Figure 6:
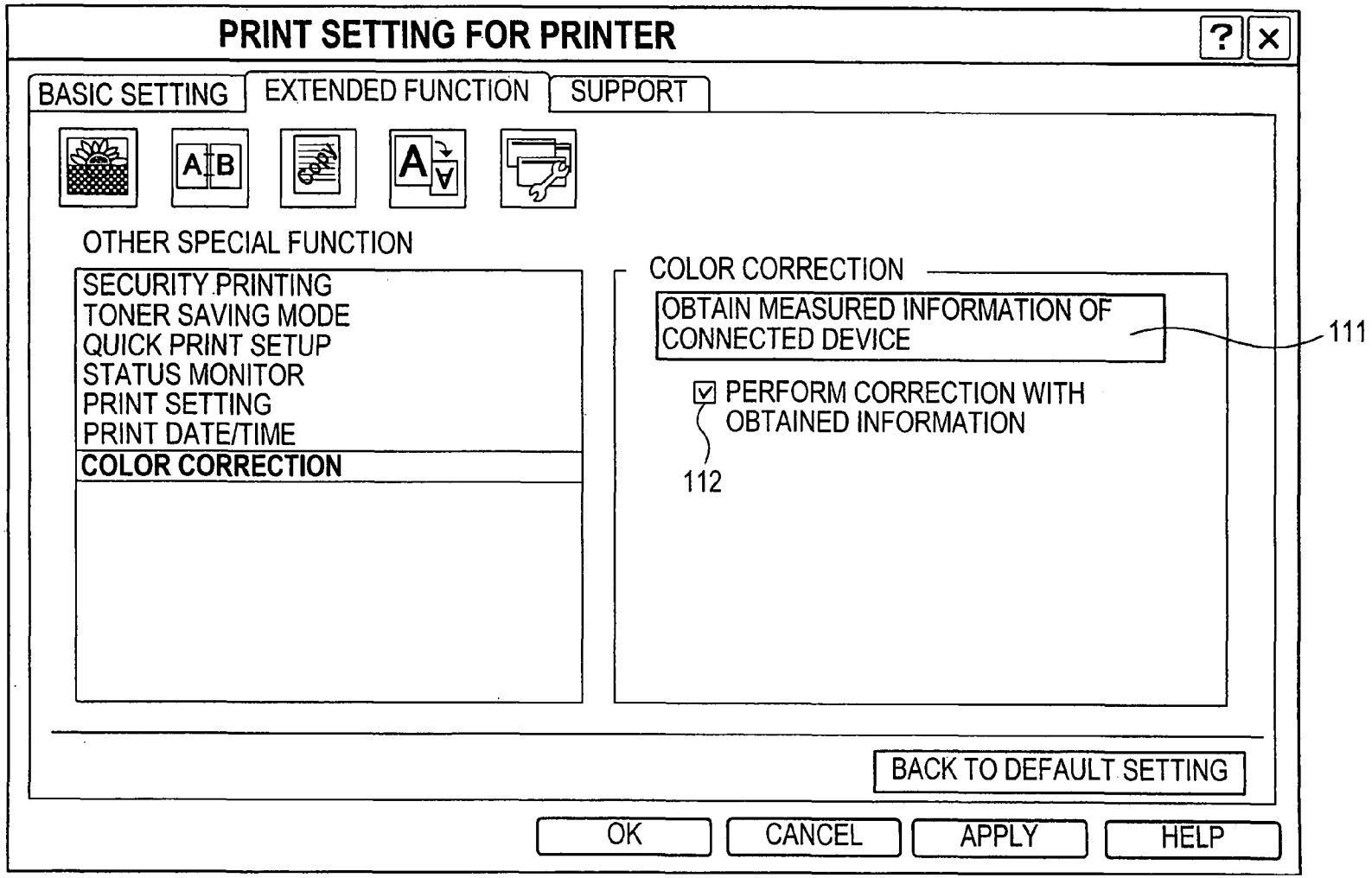
FIG. 6 is an explanatory view illustrating a print setting window displayed on a display unit of the personal computer.

The following describes a density correction process performed for the printer driver 107C by the CPU 102 of the PC 100 with reference to the flowchart shown in FIG. 5. The density correction process is initiated when a print setting window (FIG. 6) for the printer driver 107C is shown on the display unit 106, and a button 111 indicating "obtain measurement information of a connected device" is pressed (for example, by clicking on the button 111) by using the operation unit 105. In the print setting window, a check box 112 is provided so as to select whether or not density correction should be performed based on obtained information. The information selected in the check box 112 is used in the process in S112, which will be described later.

When the density correction process initiated, firstly in S101, an execution counter is set to 0 (reset). The execution counter is used so as to count the number of re-measurement of density of patches performed in S109, which will be described later.

In S102, the four colors (cyan, magenta, yellow, and black) are set as density adjustment colors. The density adjustment colors are the colors whose densities will be measured in density patches by the printer 1. In S102, all of the four colors are set as density adjustment colors.

In S103, density measurement of patches is instructed to the printer 1 with respect to the colors specified as the density adjustment colors. By this instruction, a density patch measurement process (FIG. 11), to be described later, is performed in the printer 1, wherein measured values of densities obtained from patches (measured densities) are sent from the printer 1 to the PC 100.

In S104, it is determined whether or not the measured values of densities of the patches are received. If measured values are determined to be received (S104:YES), the process proceeds to S105.

In S105, a permissible range setting process is performed wherein permissible ranges are set for the measured values of the density of the patches. The permissible ranges referred herein are criteria so as to determine whether or not a measured value of a density of a patch is normal. In the present embodiment, one permissible range is set for density patches in one color (that is, four permissible ranges for four colors are set). The permissible range setting process will be more specifically described later.

In S106, it is determined whether or not the measured values of the densities of the patches are equal to or smaller than the maximum values in the respective permissible ranges set in S105. Specifically, based on measured values of densities of patches, one representative value is calculated for each color. It is determined whether or not the representative value for each color is equal to or smaller than the maximum value in the permissible range set for each color. If all the representative values are equal to or smaller than the maximum values in the respective permissible ranges, it is determined that the measured values of the densities of the patches are equal to or smaller than the maximum values (S106:YES). On the other hand, if any of the representative values is larger than the maximum value in the associated permissible range, it is determined that the measured values of the densities of the patches are not equal to or smaller than the maximum values (S106:NO). As for the representative value, an average of the measured values for each color (a plurality of measured values which indicate different densities) can be used. That is, in a case wherein densities are measured with respect to density patches in four colors, an average is obtained with respect to each of the four colors, and the average and the maximum value in the permissible range for each color are compared.

If it is determined, in S106, that the measured values of the density of the patches are equal to or smaller than the maximum values in the permissible ranges (S106:YES), the process proceeds to S107. In S107, it is determined whether or not the measured values of the density of the patches are equal to or larger than the minimum values in the permissible ranges set in S105. In this case, as well as in S106, one representative value (an identical value to the value obtained in S106) is calculated for each color based on the measured values of densities, and it is determined whether or not the representative value for each color is equal to or larger than the minimum value in the permissible range set for each color. If all the representative values are equal to or larger than the minimum values of the permissible ranges, it is determined that the measured values of the densities of the patches are equal to or larger than the minimum values of the permissible ranges (S107:YES). On the other hand, if any of the representative values is smaller than the minimum values of the associated permissible range, it is determined that the measured values of the densities of the patches are not equal to or larger than the minimum values of the permissible ranges (S107:NO).

If it is determined in S107, that the measured values of the densities of the patches are not equal to or larger than the minimum values of the permissible ranges set in S105 (that is, the measured values are smaller than the minimum values) (S107:NO), or if it is determined, in S106, that the measured values of the densities of the patches are not equal to or smaller than the maximum values of the permissible ranges (that is, the measured values are larger than the maximum values) (S106:NO), the process proceeds to S108. In other words, the process proceeds to S108 when it is determined that the measured values of the densities of the patches are out of the permissible ranges (if any of the representative values is out of the permissible ranges).

In S108, it is determined that the value of the execution counter is smaller than a predetermined maximum value (for example, "3").

If it is determined that the value of the execution counter is smaller than the maximum value (S108:YES), the process proceeds to S109, wherein the value of the execution counter is incremented by 1.

In S110, the color whose representative density value is determined to be out of the permissible range is set as a density adjustment color. It is to be noted that, if the representative density values of a plurality of colors are determined to be out of the respective permissible ranges, the plurality colors are set as density adjustment colors. Subsequently, the process goes back to S103. As a result, re-measurement of densities is performed with respect only to the color whose density is determined to be out of the permissible range. Re-measurement is performed within the number of times set as the maximum value in the execution counter.

Figure 9:
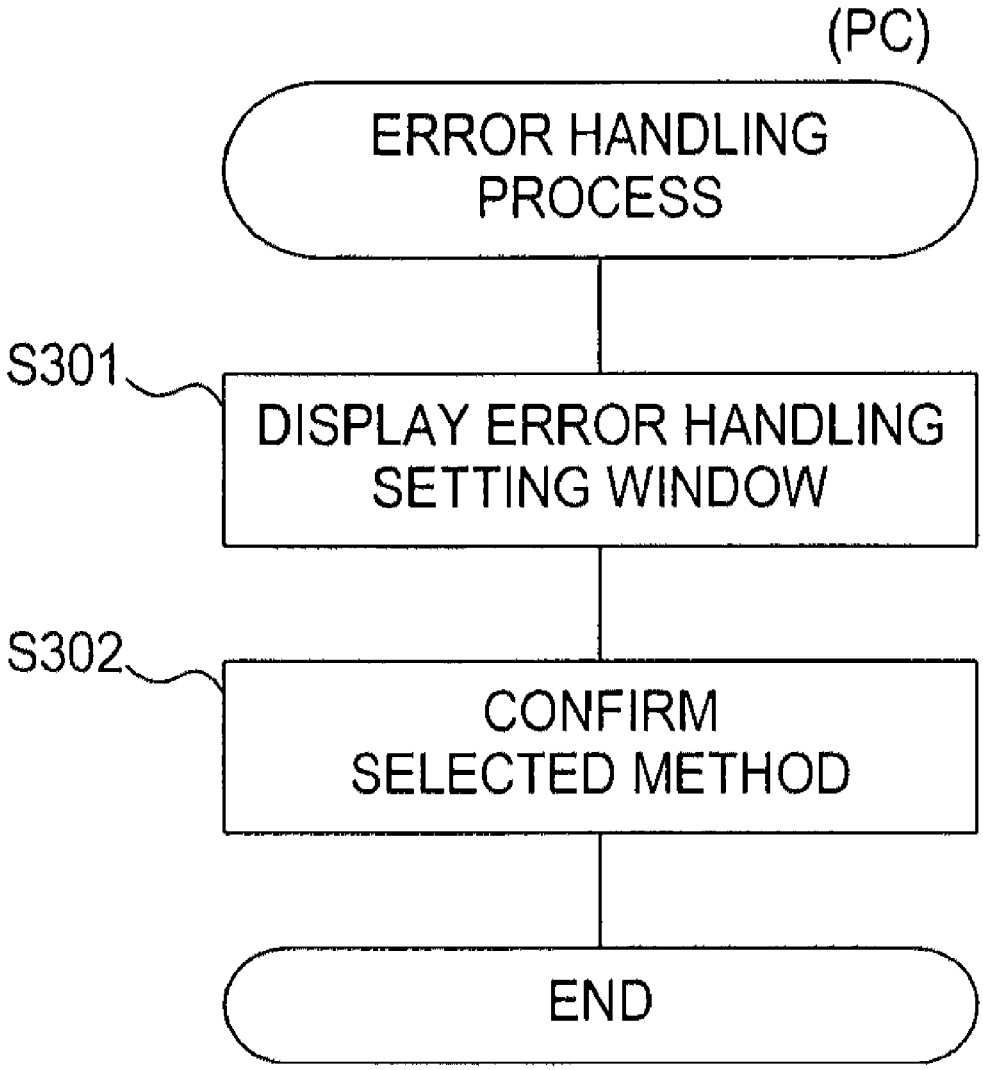
FIG. 9 is a flowchart describing an error handling process performed in the density correction process.

On the other hand, if it is determined, in S108, that the value in the execution counter is not smaller than the maximum value (S108:NO), the process proceeds to S111, wherein an error handling process is performed. Subsequently, the process proceeds to S112. The error handling process referred herein is a process so as to change a measured value of density, determined to be out of a permissible range, to another value according to a user's instruction. The error handling process will be more specifically described later (FIG. 9).

On the other hand, if it is determined, in S107, that the measured values of the densities of the patches are equal to or lager than the minimum values of the permissible ranges set in S105 (that is, all the representative values are within the permissible ranges) (S107:YES), the process proceeds directly to S112.

In S112, it is determined whether or not density correction should be performed based on the measured values of the densities of the patches. Specifically, if the check box 112, shown in the print setting window (FIG. 6), has been checked so as to select that density correction should be performed based on the obtained information when the button 111 indicating "obtain measurement information of a connected device" is pressed, it is determined that density correction should be performed.

If it is determined that density correction should be performed based on the measured values of the densities of the patches (S112:YES), the process proceeds to S113. In S113, density correction (calibration) is performed based on the measured values (changed values, if any measured value is changed by the error handling process). Then, the density correction process is finished. As a result, in a printing process to be performed later, image data, in which correction of densities is reflected, will be sent to the printer 1. Consequently, in the printer 1, the driving of the charger unit 83, the scanner unit 27, the development unit 84, and the transfer bias unit 85 is adjusted based on the density correction.

On the other hand, if it is determined that density correction based on the measured values of the densities of the patches is not to be performed (S112:NO), the density correction process is finished without any further steps.

Figure 7:
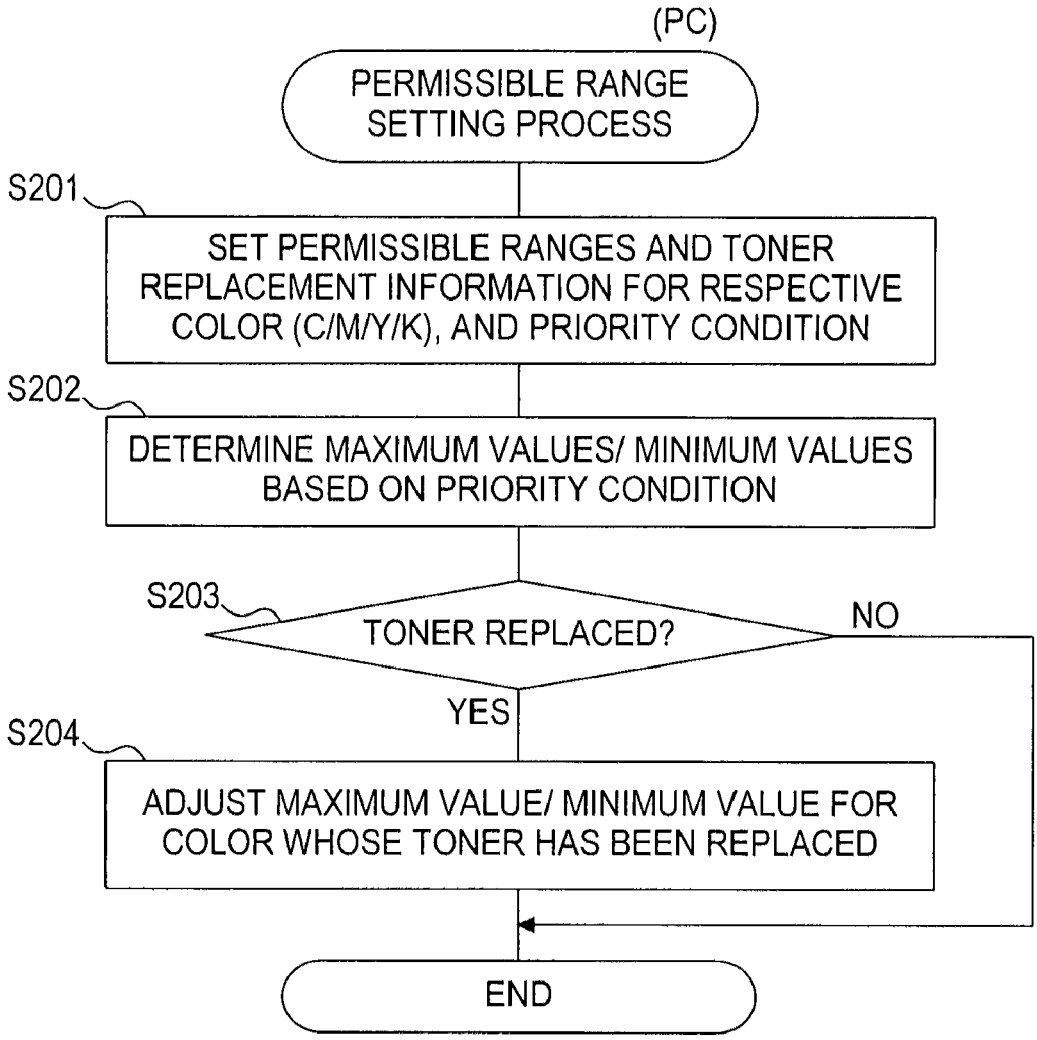
FIG. 7 is a flowchart describing a permissible range setting process performed in the density correction process.

The following describes the permissible range setting process performed in S105 of the above-described density correction process (FIG. 5) with reference to the flowchart shown in FIG. 7.

When the permissible range setting process is initiated, firstly in S201, a permissible range setting window is shown on the display unit 106.

Figure 8:
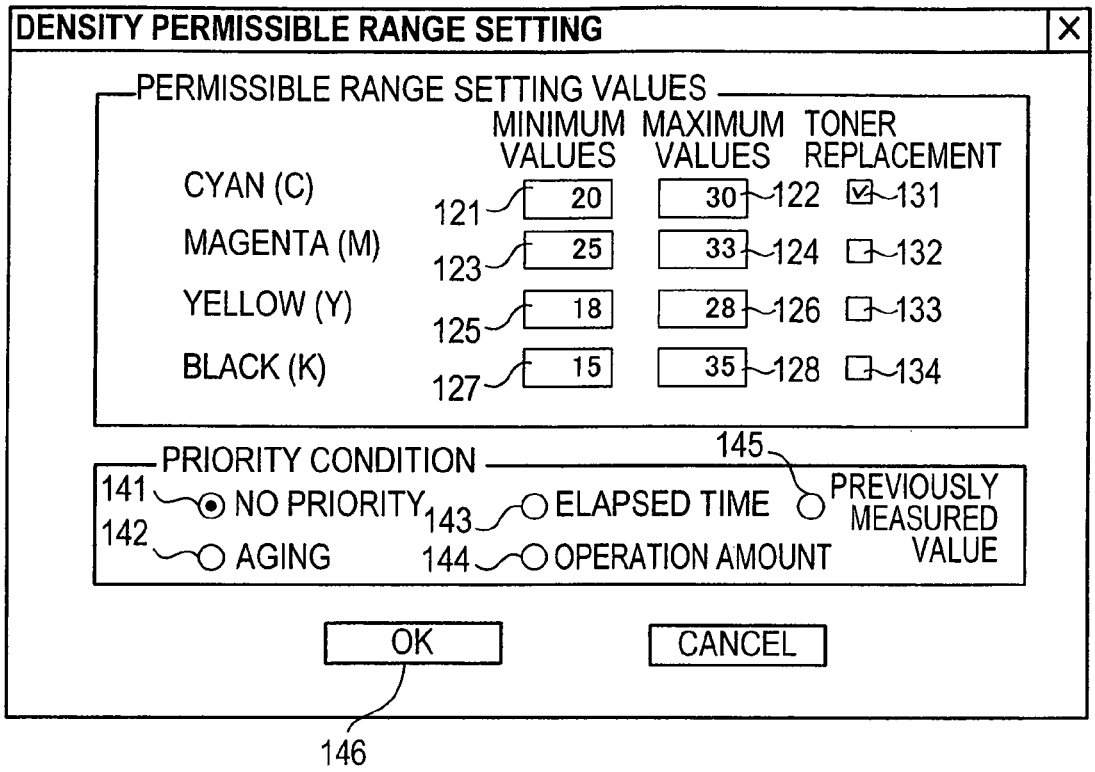
FIG. 8 is an explanatory view illustrating a permissible range setting window displayed on the display unit.

The permissible range setting window is shown as illustrated in FIG. 8, and used for setting permissible ranges of measured values of the densities of patches. Specifically, the permissible range setting window includes number input boxes 121-128, check boxes 131-134, and radio buttons 141-145. The number input boxes 121-128 are provided so as to input permissible ranges (maximum values and minimum values) for the respective colors (four colors: cyan, magenta, yellow, and black). The check boxes 131-134 are provided so as to set presence/absence of toner replacement. The radio buttons 141-145 are provided so as to set a priority condition.

In the number input boxes 121-128, minimum values and maximum values of permissible ranges for the respective colors are directly inputted by a user. The values inputted in the number input boxes 121-128 are used without being changed, if the radio button 114 indicating "no priority" is selected as a priority condition. If other priority conditions are selected, the inputted values are adjusted according to the selected priority condition, and permissible ranges are determined.

In the check boxes 131-134, information regarding whether or not toners (specifically, the development cartridges 34) for the respective colors have been replaced since density correction is previously performed is inputted by a user. If any of the development cartridges 34 has been replaced, associated check boxes 131-134 are checked.

The priority conditions are conditions for adjusting the values (maximum values and minimum values of permissible ranges), inputted into the number input boxes 121-128, to appropriate values depending on the situation. The priority conditions can be selected from one of "no priority", "aging", "elapsed time", "operation amount", and "previously measured values".

When an OK button 146 provided in the permissible range setting window is pressed via the operation unit 105, the process proceeds to S202.

In S202, based on the priority condition selected in the permissible range setting window, permissible ranges for the respective colors are determined. Specifically, determination of permissible ranges is performed as described below.

In a case wherein "no priority" is selected as a priority condition, the values inputted in the number input boxes 121-128 are set as the maximum values and the minimum values of permissible ranges for the respective colors. That is, the values inputted by a user are set without any adjustment.

In a case wherein "aging" is selected as a priority condition, the values inputted in the number input boxes 121-128 are adjusted in view of aging of the printer 1. The values obtained after the adjustment are set as the maximum values and the minimum values of permissible ranges of the respective colors. Specifically, the printer 1 is configured so as to store the total operation amount (for example, the total number of printing) since the printer 1 is initially used. Information regarding the operation amount is obtained from the printer 1, and an adjustment is performed such that permissible ranges become wider as the operation amount is lager. This is because variations in measured values of densities of patches are considered to become larger as the printer 1 ages (specifically, as the operation amount becomes larger). In the present embodiment, permissible ranges are adjusted and widened by adding a value, obtained from multiplying the operation amount W1 by a predetermined coefficient K1, to the maximum values inputted in the number input boxes 122, 124, 126, and 128, and by subtracting the obtained value from the minimum values inputted in the number input boxes 121, 123, 125, and 127.

In a case wherein "elapsed time" is selected as a priority condition, the values inputted in the number input boxes 121-128 are adjusted in view of elapsed time since density correction is previously performed. The values obtained after the adjustment are set as the maximum values and the minimum values of permissible ranges of the respective colors. Specifically, the printer 1 is configured so as to store information regarding date and time when a density correction is previously performed. Permissible ranges are adjusted so as to be widened as the elapsed time since the previous density correction is longer. This is because measured values of the densities of patches are considered to be more predictable if the elapsed time since previous measurement is shorter. In the present embodiment, permissible ranges are adjusted and widened by adding a value, obtained from multiplying the elapsed time T by a predetermined coefficient K2, to the maximum values inputted in the number input boxes 122, 124, 126, and 128, and by subtracting the obtained value from the minimum values inputted in the number input boxes 121, 123, 125, and 127.

In a case wherein "operation amount" is selected as a priority condition, the values inputted in the number input boxes 121-128 are adjusted in view of the operation amount since a density correction is previously performed. The values obtained after the adjustment are set as the maximum values and the minimum values of permissible ranges of the respective colors. Specifically, the printer 1 is configured so as to store information regarding the operation amount (for example, the number of printing) since a density correction is previously performed. Information regarding the operation amount is obtained from the printer 1, and an adjustment is performed such that permissible ranges become wider as the operation amount is lager. This is because measured values of densities of patches are considered to be more predictable if the operation amount since previous measurement is smaller. In the present embodiment, permissible ranges are adjusted and widened by adding a value, obtained from multiplying the operation amount W2 by a predetermined coefficient K3, to the maximum values inputted in the number input boxes 122, 124, 126 and 128, and by subtracting the obtained value from the minimum values inputted in the number input boxes 121, 123, 125, and 127.

In a case wherein "previously measured values" is selected as a priority condition, the values inputted in the number input boxes 121-128 are adjusted in view of measured values obtained in a previous density correction. The values obtained after the adjustment are set as the maximum values and the minimum values of permissible ranges of the respective colors. Specifically, previously measured values and currently measured values are compared. Permissible ranges are adjusted so as to be shifted by the difference. In the present embodiment, permissible ranges are adjusted and shifted by adding a value, indicating the difference of the currently measured values from the previously measured values (that is, currently measured values−previously measured values), to the maximum values inputted in the number input boxes 122, 124, 126, and 128, and by subtracting the value, indicating the difference, from the minimum values inputted in the number input boxes 121, 123, 125, and 127.

Subsequently, in S203, it is determined whether or not any of the development cartridges 34 for any color has been replaced based on the information provided in the check boxes 131-134 in the permissible range setting window.

If it is determined that some of the development cartridges 34 for some colors have been replaced (S203:YES), the process proceeds to S204, wherein the permissible range for the color whose development cartridge 34 has been replaced is adjusted so as to be narrowed. Then, the permissible range setting process is finished. In the present embodiment, a permissible range is adjusted and narrowed by subtracting a predetermined value from the maximum value determined in S202, and by adding the predetermined value to the minimum value determined in S202. This is because measured values of the densities of patches are considered to be stable, if the development cartridges 34 are replaced, as compared to measured values obtained before the development cartridges 34 are replaced.

On the other hand, if it is determined that no development cartridge 34 has been replaced (S203:NO), the permissible range setting process is finished without any further steps.

The following describes the error handling process performed in S111 in the above-described density correction process (FIG. 5) with reference to the flowchart in FIG. 9.

When the error handling process is initiated, firstly in S301, an error handling setting window is displayed on the display unit 106.

Figure 10:
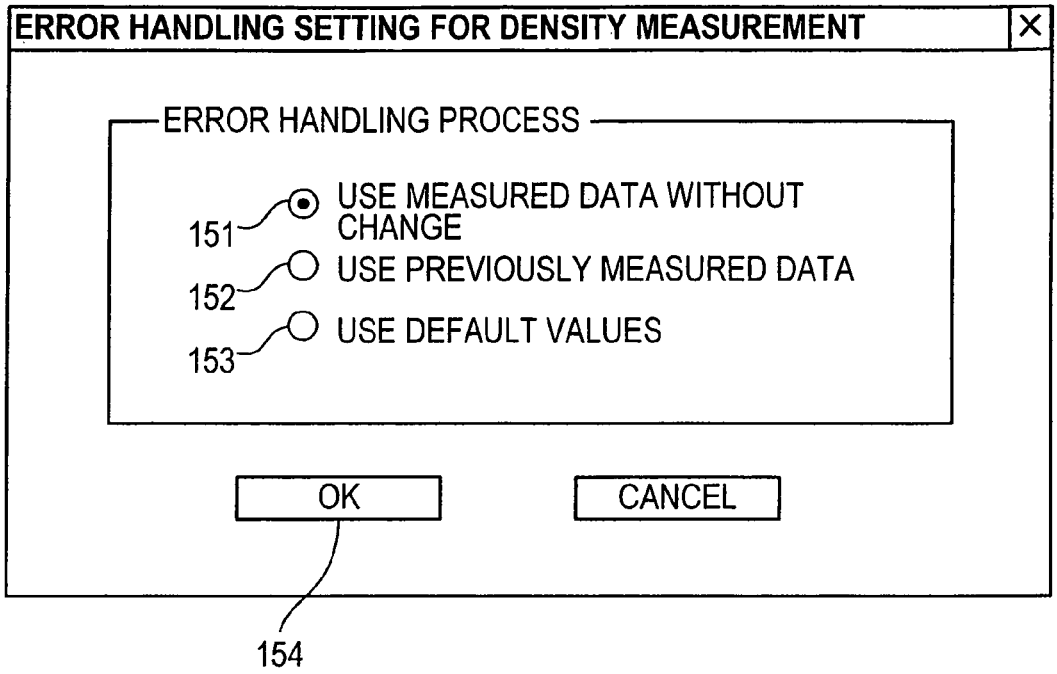
FIG. 10 is an explanatory view illustrating an error handling setting window displayed on the display unit.

The error handling setting window, shown in FIG. 10, is used so as to set a process when an error is caused. Specifically, the error handling setting window includes radio buttons 151-153 so as to select a method to handle an error from three methods: "use measured data without change", "use previously measured data", and "use default values". When one of the methods is selected via the operation unit 105, and an OK button 154, provided in the error handling setting window, is pressed via the operation unit 105, the process proceeds to S302.

In S302, the error handling method selected in S301 is confirmed, and then the error handling process is finished.

Specifically, in a case wherein "use measured data without change" is selected, measured values of the densities of patches are used without any change, even if some of the values are determined to be out of the permissible ranges.

In a case wherein "use previously measured data" is selected, the measured values of the densities of patches, which are determined to be out of the permissible ranges, are changed to the measured values obtained in a previous density correction.

On the other hand, in a case wherein "use default values" is selected, measured values of the densities of patches, which are determined to be out of the permissible ranges, are changed to predetermined values. In the present embodiment, measured values determined to be larger than the maximum values of permissible ranges are changed to the maximum values. Measured values determined to be smaller than the minimum values of permissible ranges are changed to the minimum values. That is, a least change is performed so that measured values fall within permissible ranges.

[5. Process Performed by Printer]

Figure 11:
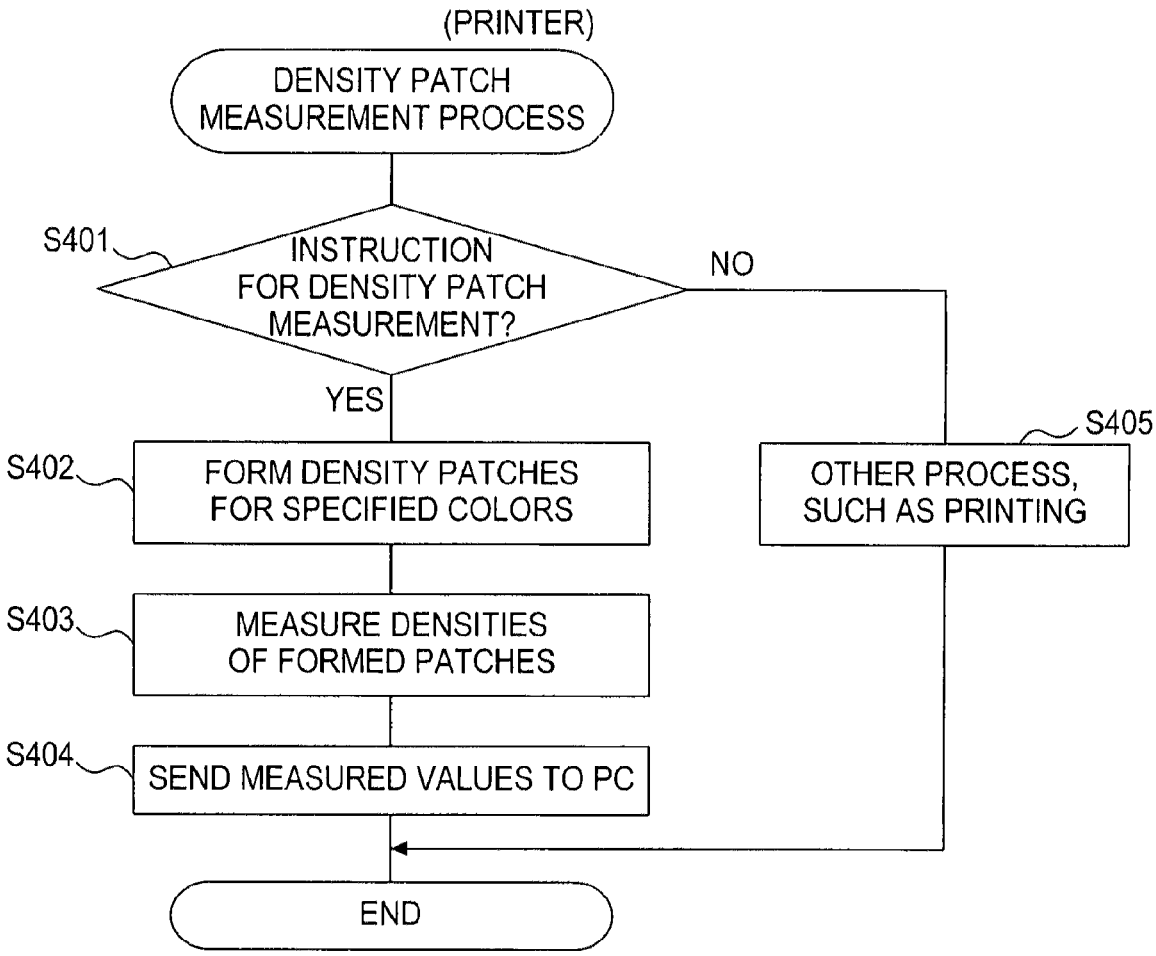
FIG. 11 is a flowchart describing a density patch measurement process performed in the printer.

The following describes, with reference to the flowchart shown in FIG. 11, a density patch measurement process performed by the CPU 80 of the printer 1. The density patch measurement process is initiated when some instruction is received from the PC 100 via the communication unit 87.

When the density patch measurement process is initiated, firstly in S401, it is determined whether or not the instruction received from the PC 100 is a measurement instruction so as to measure the densities of the patches formed in the color(s) specified as the density adjustment color(s). A measurement instruction so as to measure the densities of density patches is sent in S103 in the above-described density correction process (FIG. 5).

If it is determined that the instruction is a measurement instruction (S401:YES), the process proceed to S402, wherein density patches are formed on the conveyance belt 18 with respect to the color(s) specified as the density adjustment color(s) (the color(s) with respect to which measurement of the densities of patches is instructed).

Subsequently, in S403, the densities of the patches formed on the conveyance belt 18 are measured.

In S404, measured values of the density of the patches are sent to the PC 100, and then the density patch measurement process is finished.

On the other hand, if it is determined that the instruction is not an instruction so as to measure the densities of the patches (that is, an instruction other than a measurement instruction) (S401:NO), the CPU 80 performs a process according to the instruction (for example, a print process). Then, the density patch measurement process is finished.

[6. Effect of the Embodiment]

The image forming system according to the above-described embodiment can inhibit a density correction from being performed based on densities out of permissible ranges. Therefore, an inappropriate density correction based on incorrect measured values can be inhibited. Particularly, since a permissible range can be individually set for each color, a permissible range can be suitably set depending on the color forming a density patch.

Permissible ranges, which are criteria for determining whether or not a measurement result is correct, should be preferably set wide enough so as to include a variety of measured values obtained in a normal measurement result. Permissible ranges should also be set narrow enough so that obviously incorrect measured values are not included. However, the optimum ranges as described above are not constant.

Therefore, in the above-described image forming system, permissible ranges can be changed depending on the condition, such as the presence/absence of replacement of the development cartridges 34, the total operation amount of the printer 1, the elapsed time or the operation amount since a previous density correction, previously measured values, and so on. As a result, whether or not measured values are normal can be determined more correctly.

Furthermore, in the above-described image forming system, if measured values of the densities of patches are determined to be out of permissible ranges, re-measurement is performed within a predetermined number of times. Therefore, if the reason why normal measured values cannot be obtained is a temporary reason, normal measured values can be obtained by re-measurement. Particularly, since patches are formed in re-measurement with respect only to density determined to be out of the permissible range, consumption of toners used for forming density patches or unnecessary formation of density patches can be reduced.

Moreover, in the above-described image forming system, measured values of densities of patches, which are determined to be out of permissible ranges, can be changed to predetermined values, and density correction can be performed with the changed values. Therefore, a suitable density correction can be performed, as compared to a case wherein a density correction is performed based on incorrect measured values.

Additionally, in the above-described image forming system, setting can be changed regarding whether or not a density correction should be inhibited from being performed based on densities determined to be out of permissible ranges. Therefore, a user can select whether or not a correction should be performed based on densities determined to be out of permissible ranges. As a result, a density correction adapted more suitably to the situation can be performed.

[7. Other Embodiments]

Although one of an embodiment of the present invention is described above, it goes without saying that the present invention can be carried out in various ways.

In the above-described image forming system, when the error handling method "use default values" is selected in the error handling setting window, measured values of the densities of patches, which are determined to be out of permissible ranges, are changed to the maximum values or the minimum values in the permissible ranges. However, the way of error handling is not limited to the above-described way. A measured value may be, for example, changed to a middle value in the permissible range.

Moreover, in the above-described image forming system, information regarding whether or not the development cartridges 34 have been replaced is inputted by a user. However, the information may be obtained by some other way. For example, the printer 1 may be provided with a sensor which detects replacement of the development cartridges 34, so that the printer 1 may automatically determine whether or not the development cartridges 34 have been replaced. In this way, a determination can be accurately made.

Furthermore, in the above-described image forming system, permissible ranges are determined by adjusting permissible ranges, inputted by a user, based on a priority condition selected by the user. However, determination of permissible ranges is not limited to the above-described way. For example, a predetermined permissible range may be automatically adjusted based on the condition, such as aging of the printer 1. In this way, setting of permissible ranges at a user's end can be omitted.

Still furthermore, in the above-described image forming system, a permissible range is set for each color, and whether or not measured values of the densities of patches are normal is determined whether or not a representative value of each color calculated based on measured values of densities of patches falls within the permissible range. However, whether or not measured values fall within permissible ranges can be determined in some other way. For example, a permissible range may be set for each density patch, and it may be determined whether or not measured values of the densities of each patch fall within the permissible range. In this way, permissible ranges can be varied for a patch having a low density and a patch having a high density. For another example, whether or not the measured values of the densities of patches are normal may be determined whether or not the density of one patch with respect to each color is out of the permissible range.

Moreover, in the above-described image forming system, the color(s) whose densities are determined to be out of the permissible range(s) is/are set as the density adjustment color(s). However, all of the four colors may be set as the density adjustment colors so that density patches are always formed with respect to all the colors and the densities of all the patches are measured.

Furthermore, in the above-described image forming system, whether or not measured values of the densities of patches are normal is determined by whether or not the measured values of the densities of the patches fall within the permissible ranges. However, the way of determination is not limited to the above-described way. The determination may be made, for example, by whether or not measured values of the densities of patches are within abnormal ranges wherein measured values are determined to be incorrect. The determination may also be made by whether or not measured values of the densities of patches exceed predetermined densities. The densities of patches are measured a plurality of times, and whether or not the measured values are normal may be determined by whether or not the measured values changes.

Still furthermore, in the above-described image forming system, four colors are set as the density adjustment colors, and four density patches are formed. However, the number of density adjustment color may be an arbitrary number. For example, a plurality of density patches may be formed with respect only to one specific color.

Moreover, in the above-described embodiment, re-measurement of densities is performed with respect to newly formed density patches. However, the system may be configured such that the densities of same density patches are repeatedly re-measured.

Additionally, the above-described embodiment describes an image forming system configured such that the printer 1 and PC 100 can communicate to each other via a network. However, the image forming system of the present invention is not limited to a system constituted with a plurality of devices. The image forming system may be, for example, configured as a single device (such as a printer, a copier, and so on).

Although specific embodiment and variations have been illustrated and described herein, it is to be understood that the above description is intended to be illustrative, and not restrictive. Combinations of the above embodiment and variations will be apparent to those of skill in the art upon reviewing the above other applications in which the above structures are used. Accordingly, the scope of the invention should only be determined with reference to the appended claims, along with the full scope of equivalents to which such claims are entitled.

What is claimed is:

1. An image forming system comprising:

an image forming unit that forms an image;

a measurement unit that measures densities of a plurality of density patches formed by the image forming unit;

a correction unit that performs a density correction for the image forming unit based on the densities of the plurality of density patches measured by the measurement unit;

an inhibition unit that determines whether or not the densities of the plurality of the density patches are normal based on at least one of the densities of the plurality of density patches, and, if the densities are determined not to be normal, inhibits the correction unit from performing a density correction based on the densities of the plurality of density patches determined to be not normal; and an adjustment unit that adjusts a density range, wherein:

the inhibition unit determines whether or not the densities of the plurality of density patches are normal, based on whether or not the at least one of the densities of the plurality of density patches falls into the density range, and the adjustment unit adjusts the density range such that the density range becomes widened as an operation amount of the image forming unit increases.

2. The image forming system set forth in claim 1, wherein the image forming unit is configured such that at least one part thereof is replacable, and wherein the adjustment unit adjusts the density range such that the density range becomes narrowed, when the at least one part of the image forming unit is replaced.

3. The image forming system set forth in claim 2, wherein the inhibition unit determines whether or not the at least one of the densities of the plurality of density patches is out of the density range, and, if the at least one of the densities is determined to be out of the density range, determines that the densities of the plurality of density patches are not normal.

4. The image forming system set forth in claim 1, wherein the inhibition unit determines whether or not the at least one of the densities of the plurality of density patches is out of the density range, and, if the at least one of the densities is determined to be out of the density range, determines that the densities of the plurality of density patches are not normal.

5. The image forming system set forth in claim 1, wherein the adjustment unit adjusts the density range of the plurality of density patches based on densities of a plurality of density patches previously measured.

6. The image forming system set forth in claim 1, wherein the correction unit performs a density correction for the image forming unit based on predetermined alternative densities, when the density correction is inhibited by the inhibition unit.

7. The image forming system set forth in claim 1, wherein, when the densities of the plurality of density patches are determined not to be normal by the inhibition unit, the measurement unit performs measurement with respect to the plurality of density patches whose densities are determined not to be normal.

8. The image forming system set forth in claim 1, further comprising a patch forming unit that makes the image forming unit form the plurality of density patches.

9. The image forming system set forth in claim 8, wherein, when the densities of the plurality of density patches are determined to be not normal, the patch forming unit makes the image forming unit form a plurality of patches with respect only to the plurality of density patches whose densities are determined not to be normal.

10. The image forming system set forth in claim 1, wherein a width of the density range is individually set for each of the plurality of density patches.

11. The image forming system set forth in claim 1, further comprising a removal unit that removes an inhibition given by the inhibition unit according to externally inputted information.

12. The image forming system set forth in claim 1, wherein the image forming unit forms a plurality of patch groups, each of the plurality of patch groups includes a plurality of density patches having different densities.

13. The image forming system set forth in claim 1, wherein, when the plurality of density patches are formed by the image forming unit, the measurement unit measures the densities of the plurality of density patches formed by the image forming unit, wherein, when the densities of the plurality of density patches are measured by the measurement unit, the inhibition unit makes a determination whether or not a density correction should be performed by the correction unit based on the densities of the plurality of density patches measured by the measurement unit, the determination being made based on at least one of the densities of the plurality of density patches, and wherein, when the inhibition unit makes the determination that the density correction should be performed, the correction unit performs the density correction for the image forming unit based on the densities of the plurality of density patches measured by the measurement unit.

14. An image forming system comprising:

an image forming unit that forms an image;

a measurement unit that measures densities of a plurality of density patches formed by the image forming unit;

a correction unit that performs a density correction for the image forming unit based on the densities of the plurality of density patches measured by the measurement unit;

an inhibition unit that determines whether or not the densities of the plurality of the density patches are normal based on at least one of the densities of the plurality of density patches, and, if the densities are determined not to be normal, inhibits the correction unit from performing a density correction based on the densities of the plurality of density patches determined to be not normal; and an adjustment unit that adjusts a density range, wherein:

the inhibition unit determines whether or not the densities of the plurality of density patches are normal, based on whether or not the at least one of the densities of the plurality of density patches falls into the density range, and the adjustment unit adjusts the density range such that the density range becomes widened as one of elapsed time and an operation amount of the image forming unit since a previous density correction increases.

15. The image forming system set forth in claim 14, wherein the inhibition unit determines whether or not the at least one of the densities of the plurality of density patches is out of the density range, and, if the at least one of the densities is determined to be out of the density range, determines that the densities of the plurality of density patches are not normal.

16. An image forming system comprising:

an image forming unit that forms an image;

a measurement unit that measures densities of a plurality of density patches formed by the image forming unit;

a correction unit that performs a density correction for the image forming unit based on the densities of the plurality of density patches measured by the measurement unit;

an inhibition unit that determines whether or not the densities of the plurality of the density patches are normal based on at least one of the densities of the plurality of density patches, and, if the densities are determined not to be normal, inhibits the correction unit from performing a density correction based on the densities of the plurality of density patches determined to be not normal; and an adjustment unit that adjusts a density range, wherein:

the inhibition unit determines whether or not the densities of the plurality of density patches are normal, based on whether or not the at least one of the densities of the plurality of density patches falls into the density range, the image forming unit is configured such that at least one part thereof is replacable, and the adjustment unit adjusts the density range such that the density range becomes narrowed, when the at least one part of the image forming unit is replaced.

* * * * *